US009186530B2

(12) United States Patent
Jones et al.

(10) Patent No.: US 9,186,530 B2
(45) Date of Patent: Nov. 17, 2015

(54) SAFETY LINE TRAVELLER

(75) Inventors: Owain Jones, Chippenham (GB); Karl Jones, Devizes (GB)

(73) Assignee: LATCHWAYS PLC, Devizes (GB)

( * ) Notice: Subject to any disclaimer, the term of this patent is extended or adjusted under 35 U.S.C. 154(b) by 590 days.

(21) Appl. No.: 13/393,245

(22) PCT Filed: Sep. 1, 2010

(86) PCT No.: PCT/GB2010/001653

§ 371 (c)(1),
(2), (4) Date: May 10, 2012

(87) PCT Pub. No.: WO2011/027109

PCT Pub. Date: Mar. 10, 2011

(65) Prior Publication Data

US 2012/0217092 A1 Aug. 30, 2012

(30) Foreign Application Priority Data

Sep. 2, 2009 (GB) ..... 0915277.8
Oct. 6, 2009 (GB) ..... 0917481.4
Apr. 9, 2010 (GB) ..... 1005933.5

(51) Int. Cl.
*A62B 35/00* (2006.01)

(52) U.S. Cl.
CPC ..... *A62B 35/0081* (2013.01); *A62B 35/0056* (2013.01); *A62B 35/0062* (2013.01); *A62B 35/0087* (2013.01)

(58) Field of Classification Search
CPC ..... A62B 35/005; A62B 35/0056; A62B 35/0062; A62B 35/0075; A62B 35/0081; A62B 35/0087
See application file for complete search history.

(56) References Cited

U.S. PATENT DOCUMENTS

| | | | | |
|---|---|---|---|---|
| 1,087,773 | A * | 2/1914 | Johnson | 104/246 |
| 4,521,000 | A * | 6/1985 | Dodge, Jr. | 254/391 |
| 5,350,037 | A * | 9/1994 | Ghahremani | 182/3 |
| 6,125,766 | A * | 10/2000 | Flux | 104/182 |
| 6,488,118 | B1 * | 12/2002 | Corriveau | 182/36 |
| 6,530,454 | B1 * | 3/2003 | Renton et al. | 182/36 |
| 2002/0189488 | A1 * | 12/2002 | Ostrobrod | 104/91 |
| 2007/0119653 | A1 * | 5/2007 | Brown et al. | 182/36 |
| 2009/0056083 | A1 * | 3/2009 | Lara et al. | 24/115 R |

FOREIGN PATENT DOCUMENTS

| | | | |
|---|---|---|---|
| DE | 29517560 | * 11/1995 | A62B 35/0062 |
| DE | 202007012804 | 2/2009 | |
| EP | 0608164 | 7/1994 | |
| GB | 2420820 | 6/2006 | |
| WO | WO02092171 | 11/2002 | |

* cited by examiner

*Primary Examiner* — Colleen M Chavchavadze
(74) *Attorney, Agent, or Firm* — Gordon & Jacobson, PC

(57) ABSTRACT

A traveler for safety line for a fall arrest system has a slot extending to the exterior of the traveler and a safety line locating shuttle provided on-board the traveler wherein the safety line locating shuttle is movable relative to the slot along a predetermined path in a direction across the slot. This aids in accurate positioning of the safety line with respect to the traveler. The slot can be defined between opposed slot edges which are movable relative to one another to reconfigure the slot.

16 Claims, 17 Drawing Sheets

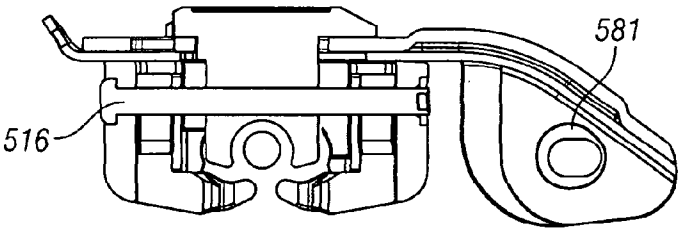

FIG. 35

Firstly the karabiner is removed allowing the inner plate to be able to slide

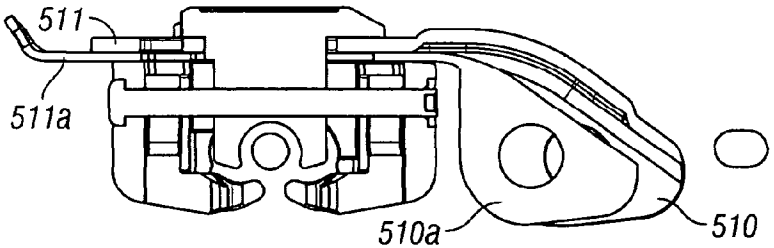

FIG. 36

The inner plate can now slide to the open position making a gap for the paddle to slide through. Note the hole for the karabiner is now blocked, preventing the user from attaching.

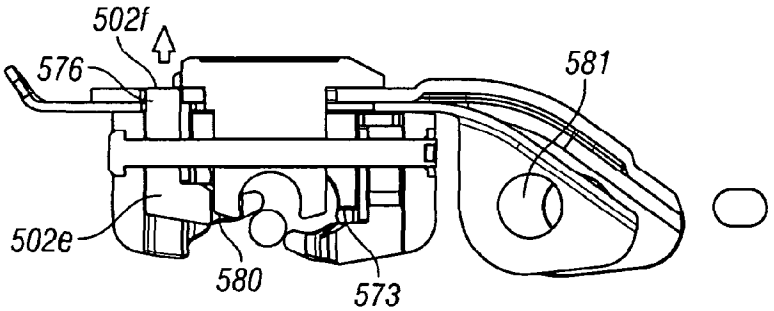

FIG. 37

The paddle can now lift up through the inner plate creating a gap for the cable to pass through. Removing the device from the cable.

SAFETY LINE TRAVELLER

CROSS-REFERENCE TO RELATED APPLICATIONS

This application claims priority from PCT/GB/2010/001653 filed on Sep. 1, 2010, GB 0915277.8 filed on Sep. 2, 2009, GB 0917481.4 filed on Oct. 6, 2009, and GB 1005933.5 filed on Apr. 9, 2010, all of which are hereby incorporated by reference in their entireties.

BACKGROUND OF THE INVENTION

1. Field of the Invention

The present invention relates to a safety line traveler, particularly to such a traveler for use in a fall arrest or fall safety system.

2. State of the Art

In order to protect personnel from falls when working at height it is usual and often a legal requirement, to provide an elongate safety line running across a length of the area in which the personnel are to work. The personnel are attached to the safety line by a lanyard which is provided with a traveler to which the lanyard is secured. The traveler is fixed to the safety line such that it can travel along the safety line. The flexible lanyard is connected at its other end to a harness worn by the user. When connected the user can move with respect to the safety line, tension on the lanyard as the user moves causes the traveler to be dragged to move along the safety line.

The safety line is anchored at each end. In order to allow a long uninterrupted length of safety line a number of intermediate supports are typically provided to support the safety line at predetermined positions along its length. The traveler and supports are designed to cooperate such that the traveler can automatically pass the along the safety line past the intermediate supports with the minimum of interference or snagging.

Such a safety line system having intermediate supports and a traveler arranged to pass along the safety line past the intermediate supports is disclosed in for example WO02/092171. In the system disclosed the intermediate supports are provided with deflector or guide surfaces arranged to abut the traveler on approach to the intermediate support so as to re-orientate the traveler to enable smooth passage past the intermediate support.

The issue is to orientate the slot in the traveler to permit the traveler to move smoothly past the intermediate support when the lanyard is tending to pivot or rotate the traveler out of the optimum alignment for passage past the intermediate support.

In so called horizontal systems (often used on roof top structures) the safety line is typically positioned at waist height and the user often lifts the lanyard held in one hand when walking adjacent the safety line. This causes the traveler to rotate on the safety line to a position in which the traveler is orientated out of the optimum alignment for passage past the intermediate support. As a result the traveler will impact with the intermediate support and snag or jolt.

Similar problems can exist for overhead safety line systems.

SUMMARY OF THE INVENTION

The present invention is intended to provide an improved traveler for a fall arrest or fall safety system.

According to a first aspect, the present invention provides a traveler for safety line for a fall arrest system, the traveler comprising:

a slot extending to the exterior of the traveler;

a safety line locating shuttle provided on-board the traveler wherein the safety line locating shuttle is movable relative to the slot along a predetermined path in a direction across the slot.

The slot is preferably effectively re-configurable between an open condition in which the slot dimension is of a first size and a closed condition in which the slot remains, but at a smaller size.

Beneficially in certain realisations, biasing means is provided to bias the slot to the closed position from the open position.

It may be preferred that slot is inhibited from re-configuration from the closed position to the open position unless the movable safety line locating shuttle is located in a predetermined position.

It is preferred that the safety line locating shuttle comprises a shuttle configured to embrace and guide a safety line. Beneficially, the safety line locating shuttle comprises a receiving recess or seat for receiving the safety line.

The shuttle is preferably spaced from the slot in-board the traveler of the slot, preferably such that the safety line is arranged to be positioned intermediate or between the shuttle and the slot.

The slot is dimensioned to be smaller than the transverse dimension (diameter) of the safety line such that the safety line cannot pass sideways through the slot.

In one embodiment the safety line locating shuttle is beneficially slidable (preferably in reciprocating motion) relative to the slot.

Preferably the safety line locating shuttle is movable in a direction transversely across the slot between a first extreme position, more to one side of the slot, and a second extreme position, more toward the other side of the slot.

In one preferred embodiment, the safety line locating shuttle may be slidably mounted to a traveler body element.

Beneficially, the arrangement further comprises a load member for attachment to fall safety equipment. In certain embodiments, it is preferred that the load member can be rotated through 180 to 360 degrees about an axis to enable the load member to project in one of opposed directions from the traveler. The axis of rotation is preferably perpendicular to the axial direction of the safety line.

In a preferred embodiment, the slot is defined between opposed slot edges, which are movable relative to one another to reconfigure the slot.

This provides a further aspect of the invention which may be defined in general terms as a traveler for safety line for a fall arrest system, the traveler comprising a slot extending to the exterior of the traveler, characterised in that the slot is defined between opposed slot edges which are movable relative to one another to reconfigure the slot.

Beneficially a respective slot edge is freely deflectable to reconfigure the slot in use.

In addition to the slot being re-configurable in use to vary the size of the slot when attached to and drawn along the safety line, it is preferred that the slot is re-configurable between an open condition in which the slot dimension is of a first size and a closed condition in which the slot remains, but at a smaller size. This permits the traveler to be mounted to the safety line at a point intermediate the ends of the safety line. In the open configuration the slot is dimensioned to permit the safety line to pass through sideways. In the closed condition the safety line cannot pass through the slot because the slot is not large enough to permit this. Nonetheless in the closed configuration the slot is re-configurable, over a permitted range of movement, in use to vary the size of the slot when attached to and drawn along the safety line.

In certain realisations it is preferred that biasing means is provided to bias the slot to the closed position from the open position.

In certain embodiments, it is preferred that a respective slot edge is deflectable by means of pivotal movement to reconfigure the slot. In such an embodiment a respective edge may be provided on a support element which is pivotally mounted to the traveler. Beneficially the pivot axis is in a direction generally parallel to the axis of the safety line when in the traveler.

In certain embodiments, it is preferred that a respective slot edge is deflectable by means of linear movement, such as sliding movement, to reconfigure the slot. In such an embodiment a respective edge may be provided on a support element which is linearly movably (for example slidably) mounted to the traveler.

In certain embodiments, it is preferred that each of the opposed edges defining the slot are provided on a respective support element which is movably (preferably linearly) mounted to the traveler.

Beneficially, the/or each slot edge is biased under gravity to a neutral position.

Beneficially, in all positions during operation, the slot width between the edges is small enough to prevent the safety line passing via the slot out of captive engagement with the traveler.

According to a further aspect, the invention provides a traveler for a safety line for a fall arrest system, the traveler comprising a traveler body having a zone for receiving a safety line and a slot in communication between the zone and the exterior of the traveler; and a load element facilitating attachment to a person, the load element comprising an arm which is arranged to extend outwardly from the body and in a direction to cross the level of the safety line receiving zone in the traveler.

In one embodiment, it may be preferred that the biasing means comprises resilient biasing means which is energised when the slot moves to the open position and acts to restore the slot to the closed position.

It is preferred that a release actuator arrangement is provided, which requires deployment from a home position in order to permit re-configuration of the slot from the closed position to the open position. Beneficially, the biasing means is associated with the release actuator arrangement.

In one embodiment, it is preferred that the release actuator arrangement comprises a plurality of actuators positioned with one on either opposed side of the traveler. This ensures that the slot can only be opened deliberately and ameliorates the likelihood of accidentally opening the slot when the user is connected to the safety line.

It is preferred that the movable safety line receiving element (such as a shuttle) is arranged to be held in a restrained position when the slot is in the open position.

Where a release actuator arrangement is provided, which requires deployment from a home position in order to permit re-configuration of the slot from the closed position to the open position, it may be preferable that the movable safety line receiving element (such as the shuttle) is arranged to be held in the restrained position by deployment of the release actuator arrangement.

Other preferred features are in accordance with earlier described aspects.

The invention will now be further described in specific embodiments by way of example only and with reference to the accompanying drawings.

BRIEF DESCRIPTION OF THE DRAWINGS

FIGS. 35 to 36 are explanatory sectional views showing re-configuration of the device of FIGS. 29 to 34 between the open configuration and the closed configuration enabling mounting to a safety line;

FIGS. 35 to 37 are explanatory sectional views showing re-configuration of the device of FIGS. 29 to 34 between the open configuration and the closed configuration enabling mounting to a safety line;

DETAILED DESCRIPTION OF THE PREFERRED EMBODIMENTS

Figure 2:
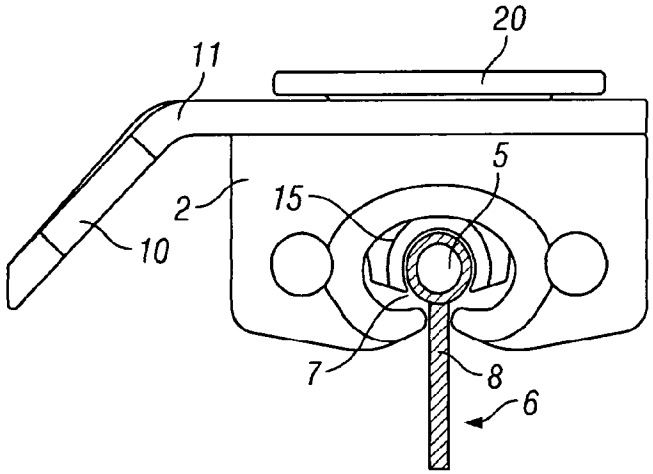
FIG. 2 is a view of the embodiment of FIG. 1 mounted on an intermediate support for a safety line.

Referring to the drawings and initially to FIGS. 1 to 5, there is shown a safety line traveler 1 comprising a body 2 arranged to be held captive on and run along a safety line. The body is provided with an interior space 3 for receiving the safety line and a slot 4 defined between a pair of edges 2*a* 2*b* running in the longitudinal direction of the safety line. The slot extends to the exterior of the traveler. As shown in FIG. 2 the safety line is supported by intermediate supports 6 which have a cylindrical portion 7 defining a cylindrical channel 5 through which the safety line passes. A narrow section 8 of the support 6 extends from the cylindrical portion 7 to a distal anchor portion of the support (not shown) enabling the support to be secured to a support post or directly to a structure (usually by means of a threaded bolt or other mechanical fixing. Such supports are well known in the art.

As can be seen from the drawings, the slot 4 defined between the pair of edges 2*a* 2*b* running in the longitudinal direction of the safety line is of a gap sufficiently large to allow the narrow section 8 to pass through the gap as the traveler moves past the intermediate support. However the slot 4 defined between the pair of edges 2*a* 2*b* is sufficiently small so as not to allow the safety line to pass out of the interior space 3 of the body when the traveler is moving along the safety line between the intermediate supports. Consequently it can be seen that it is important to align the slot 4 defined between the pair of edges 2*a* 2*b* accurately with the narrow section 8 of the support 6 in the absence of any other means of correcting for mis-alignment.

In the arrangement of FIGS. 1 to 5, the lanyard or other means of attachment to the user is connected, typically by a karabiner, attached to an eye 10 provided in an arm 11 extending from the body 2.

Positioned in the body 2 at the interior space 3 is a safety line locating shuttle 15 that is able to move in a predetermined manner in the direction of separation of the pair of edges 2*a* 2*b*. Typically the safety line locating shuttle 15 is capable of moving, in reciprocating motion, between extreme positions across at least a part of the slot 4 defined between the pair of edges 2*a* 2*b*. This may be achieved for example by the shuttle 15 being mounted to be slidable along a slider pin 16 mounted in the body 2 and extending across the interior space 3 of the body 2. The safety line locating shuttle 15 is provided with an arcuate recess 14 in a lower portion arranged to locate with the safety line, or the cylindrical head 7 of the intermediate support, depending upon whether the shuttle is passing the intermediate support 6 or along a length of the safety line.

As shown in FIG. 2, the shuttle is located centrally over the slot 4 as it passes the intermediate support 6 such that the narrow section 8 can move through the slot 4. This is because the traveler 1 is in its neutral position as it is dragged past the support 6, in which the traveler is orientated horizontally (i.e. the slot is horizontal).

Figure 3:
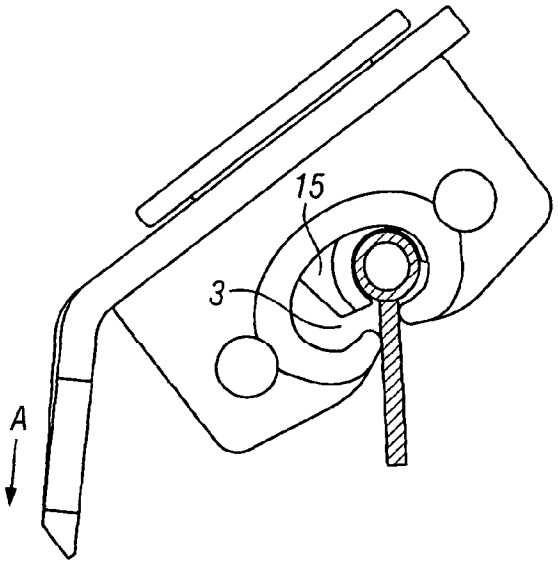
FIGS. 3 and 4 are views of the embodiment of FIGS. 1 and 2 at opposite extremes of rotational orientation with respect to the intermediate support of the safety line.
Figure 1:
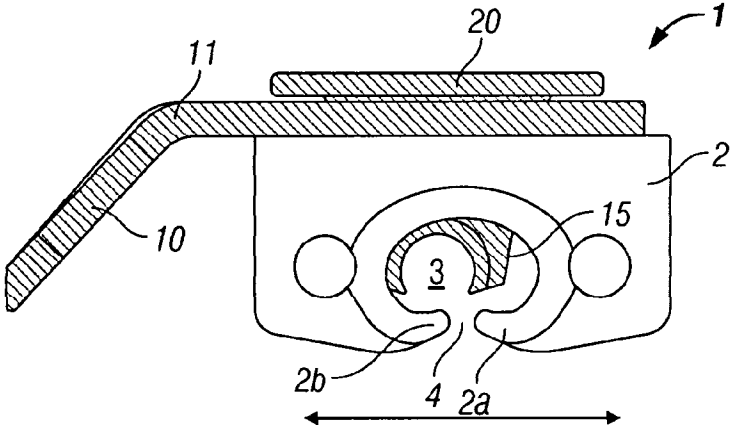
FIG. 1 is a schematic side view of a first embodiment of traveler in accordance with the invention.

As shown in FIG. 3, if the traveler 1 is dragged past the intermediate support 6 in circumstances in which the lanyard is pulling downwardly on the arm 11 (arrow A), the traveler body 2 rotates such that the slot 8 is no longer orientated horizontally. Due to the nature of its construction, when this occurs, the shuttle 15 becomes re-orientated by moving upwardly and to the right in the figure to its extreme right position. This permits the narrow part 8 of the intermediate support 6 to pass through the slot 4. Effectively the point of location of the cylindrical tube 7 in the body of the traveler 2 is moved to compensate for the re-orientation of the traveler body about the axis of the safety line or the cylindrical tube 7 of the support 6.

Figure 4:
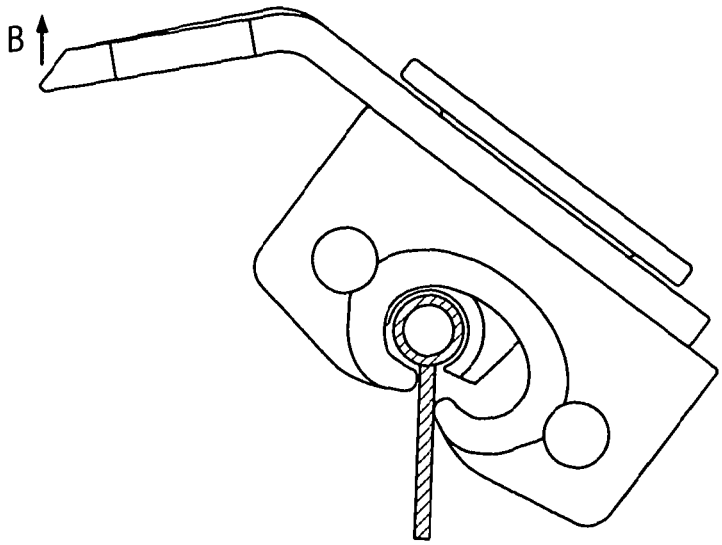
Figure 5:
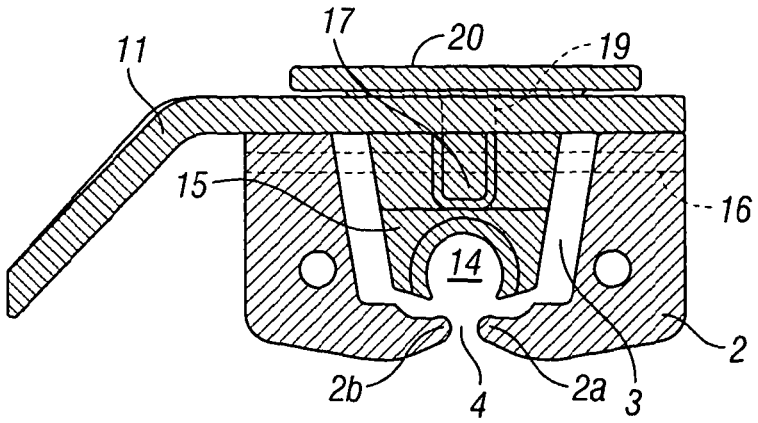
FIG. 5 is a cross sectional view of the embodiment of the preceding figures.

Conversely, and as shown in FIG. 4 if the traveler 1 is dragged past the intermediate support 6 in circumstances in which the lanyard is pulling upwardly on the arm 11 (arrow B), the traveler body 2 rotates such that the slot 8 is no longer orientated horizontally. Due to the nature of its construction, when this occurs, the shuttle 15 becomes re-orientated by moving upwardly and to the left in the figure to its extreme left position. This permits the narrow part 8 of the intermediate support 6 to pass through the slot 4.

The slot 4 can therefore be dimensioned to permit the narrow section 8 of the support to pass in a wide degree of differing angular orientations, whilst ensuring that the safety line (on approach to, or exit from the support) or the support tube 7 is accurately held in the appropriate position with respect to the traveler body.

In the embodiment shown, the shuttle 15 is attached to the arm 11, such that as the shuttle 15 moves so too does the arm 11. The arm is however rotatable through at least 360 degrees with respect to the shuttle 15. A mounting spindle 17 passes through a circular aperture 19 in the arm 11 to be received in a bore 18 in the upper surface of the shuttle 15. The spindle 19 is provided with a cap 20. The slider pin 16 passes through the spindle 19. The arm in most cases will only be required to be rotatable with respect to the shuttle 15 or traveler body 2 through 180 degrees. This will enable the arm to be used on either opposed side of the safety line.

Figure 6:
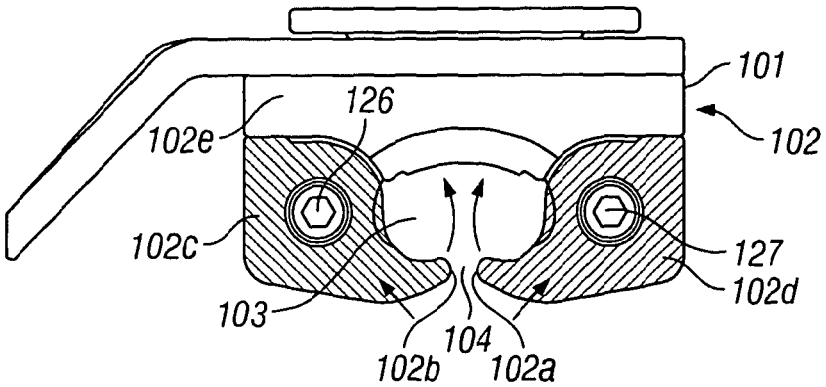
FIG. 6 is a schematic side view of an alternative embodiment of a traveler in accordance with the invention.
Figure 7:
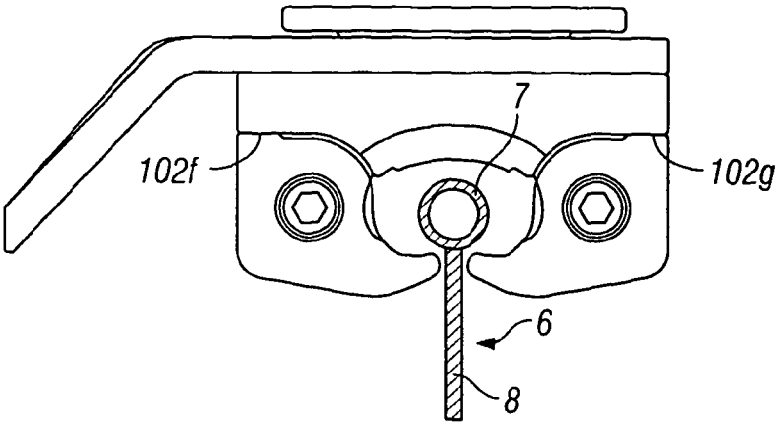
FIG. 7 is a view of the embodiment of FIG. 6 mounted on an intermediate support for a safety line.

Referring now to the traveler arrangement shown in FIGS. 6 to 9, the traveler 101 comprises a traveler body 102 arranged to be held captive on and run along a safety line. The body 102 is provided with an interior space 103 for receiving the safety line and a slot 104 defined between a pair of edges 102*a* 102*b* running in the longitudinal direction of the safety line. As shown in FIG. 7 the safety line is supported by intermediate supports 6 which have a cylindrical tube portion 7 defining a cylindrical channel 5 through which the safety line passes. A narrow section 8 of the support 6 extends from the cylindrical portion 7 to a distal anchor portion of the support (not shown) enabling the support to be secured to a support post or directly to a structure (usually by means of a threaded bolt or other mechanical fixing. Such supports are well known in the art.

As in respect of the previously described embodiment, the users lanyard (or other means of attachment to the user) is connected, typically by a karabiner, attached to an eye 110 provided in an arm 111 extending from the body 2.

In this embodiment the slot 104 is defined between the pair of edges 102*a* 102*b* each provided on a separate pivotally movable paddle or element 102*c* 102*d*. Each paddle or element 102*c* 102*d* is mounted to an upper body element 102*e* by means of a separate pivot fixing 126 127. In a 'normal' configuration as shown in FIG. 7, the paddles are arranged to be orientated under gravity such that a turning moment arises about the pivot fixings 126 127 to urge the shoulders 102*f* 102*g* into engagement with reaction surfaces provided on the upper body element 102*e*. In an alternative embodiment biasing means (such as spring elements) may be used to bias the paddle elements 102*c* 102*d* to a normal position (which may be the position shown in FIG. 7 or another 'home position).

In this orientation (as shown in FIG. 6/7) the slot 104 between edges 102*a* 102*b* is sufficiently large to allow the narrow section 8 to pass through the gap as the traveler moves past the intermediate support. However the slot 104 defined between the pair of edges 102*a* 102*b* is sufficiently small so as not to allow the safety line to pass out of the interior space 103 of the body when the traveler is moving along the safety line between the intermediate supports. Consequently it can be seen that it is important to align the slot 4 defined between the pair of edges 2*a* 2*b* accurately with the narrow section 8 of the support 6 in the absence of any other means of correcting for mis-alignment.

However in this embodiment, it is possible for the paddles 102*c* 102*d* to pivotally re-orientate from the normal position when approaching or passing the intermediate support 6 in the event that the traveler has been forced to a rotationally re-oriented position with respect to the safety line or the cylindrical tube 7 of the intermediate support.

Figure 8:
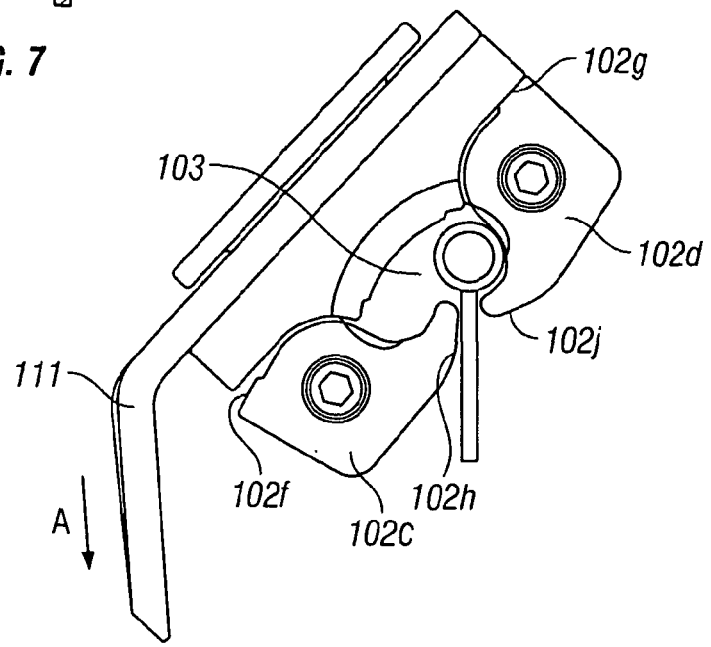
FIGS. 8 and 9 are views of the embodiment of FIGS. 6 and 7 at opposite extremes of rotational orientation with respect to the intermediate support of the safety line.

As shown in FIG. 8, if the traveler 101 is dragged past the intermediate support 6 in circumstances in which the lanyard is pulling downwardly on the arm 111 (arrow A), the traveler body 102 rotates such that the slot 104 is no longer orientated horizontally. Due to the nature of its construction, particularly the provision of the inclined lower surface 102*h* of paddle 102*c*, when approaching the support 6, the paddle 102*c* becomes re-orientated as a result of contact between surface 102*h* and the leading edge of the narrow section 8 of the support, so as to displace the paddle 102*c* such that its edge 102*b* rotates upwardly toward the space 103. This permits the narrow part 8 of the intermediate support 6 to pass through the re configured slot 104. Effectively the slot 104 is re-configured by the pivoting of paddle 102*c* in order to compensate for the re-orientation of the traveler body about the axis of the safety line or the cylindrical tube 7 of the support 6.

Figure 9:
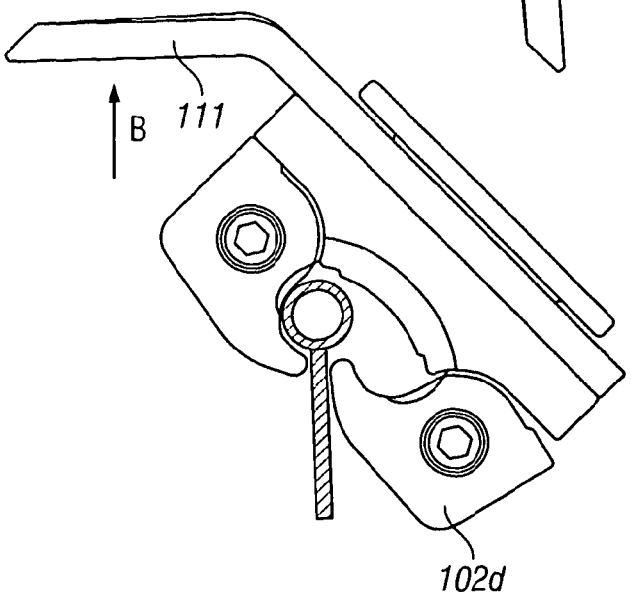

Conversely, and as shown in FIG. 9 if the traveler 101 is dragged past the intermediate support 6 in circumstances in which the lanyard is pulling upwardly on the arm 111 (arrow B), the traveler body 2 rotates such that the slot 104 is no longer orientated horizontally. Due to the nature of its construction, when this occurs, the paddle 102*d* becomes re-orientated as a result of contact between surface 102*j* and the leading edge of the narrow section 8 of the support, so as to displace the paddle 102*d* such that its edge 102*a* rotates upwardly toward the space 103. This permits the narrow part 8 of the intermediate support 6 to pass through the re configured slot 104. Effectively the slot 104 is re-configured and altered in spacing distance, by the pivoting of paddle 102*c* in order to compensate for the re-orientation of the traveler body about the axis of the safety line or the cylindrical tube 7 of the support 6.

In both extremes of reconfiguration of the paddles, the slot 104 is maintained at a dimension at which the tube 7 and/or the safety line cannot pass through The traveler 101 can therefore be configured automatically permit the narrow section 8 of the support to pass in a wide degree of differing angular orientations of the traveler.

In this embodiment also the arm is however rotatable through at least 180 degrees (even possibly through 360 degrees) being mounted via a spindle attached to cap 320 which extends through a circular mounting aperture in the arm 311 to be received in a bore in the valve body. This enables 180 or 360 degrees rotation with respect to the valve body enabling the device to be adapted for use on either of the opposed sides of a safety line.

Figure 10:
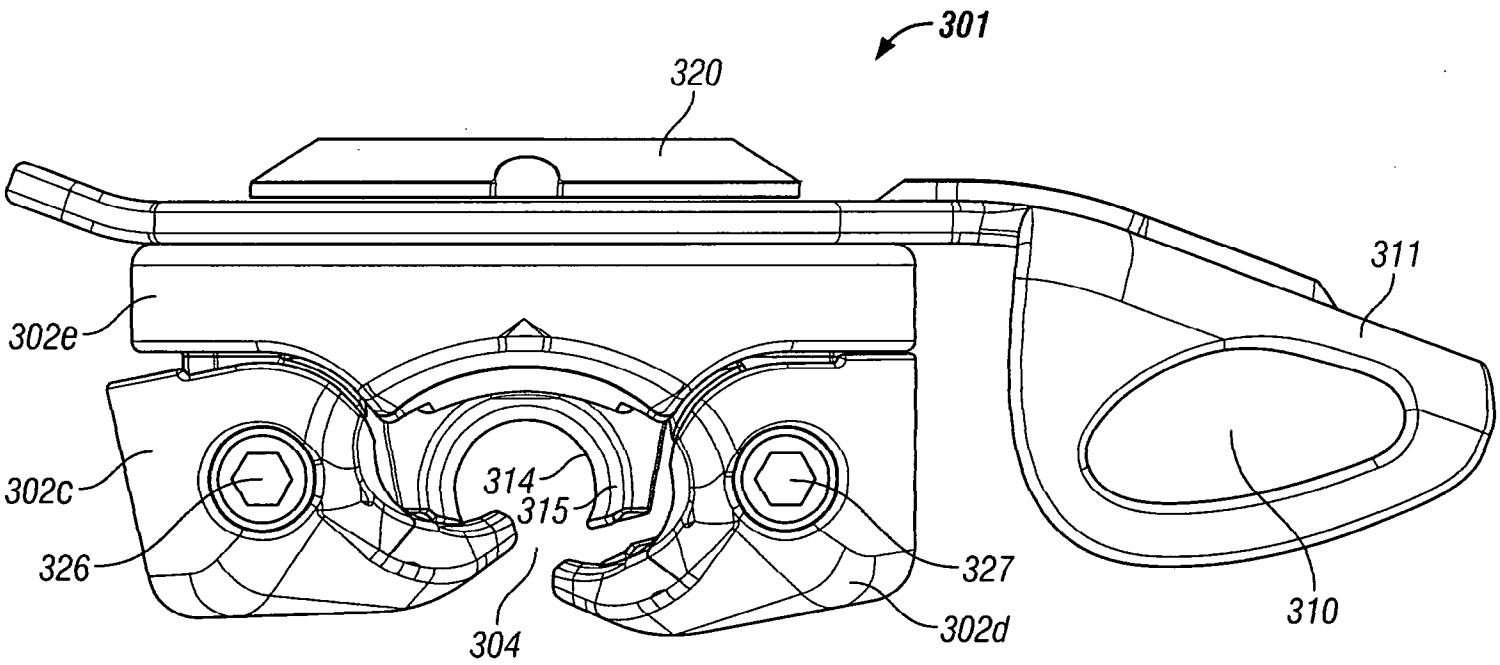
FIG. 10 is a schematic side view of an alternative embodiment of a traveler in accordance with the invention.

Referring now to the embodiment of FIG. 10, there is shown a safety line traveler that combines the features of the re-orientatable, slidable shuttle 15 of the first embodiment with the re-orientatable paddles of the second embodiment. In FIG. 10 the shuttle 315 is shown and is mounted to the main traveler body 302*e* by means of a slider pin extending across the traveler upper body 302*e*. The pin is not shown in FIG. 10, but it will be appreciated that the shuttle 315 is provided with a bore through which the slider pin extends such that the shuttle can slide across the body from one extreme position to another. The slot 304 is defined between the edges of the paddles 302*c* 302*d*, which are both pivotally 6 mounted to the upper traveler body 302*e* by means of the pivot fixings 326 327.

The embodiment of FIG. 10 having both the shuttle feature and the re-orientatable paddles provides that the arrangement is technically versatile and highly effective in smoothly passing by an intermediate support. The embodiment of FIG. 10 also has an attachment eye 310 in the arm 311 that is oriented to define a pass through direction which is in the same general direction as the direction in which the safety line extends (i.e. in the same general direction of travel as the direction of travel of the traveler). This provides technical advantage.

Figure 11:
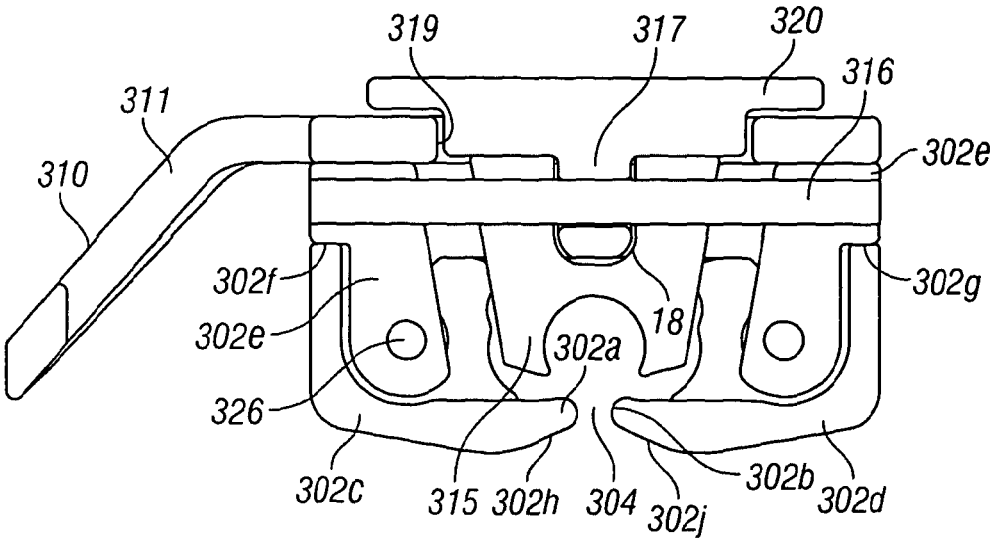
FIG. 11 is a schematic sectional view of an embodiment similar to the embodiment of FIG. 10.

Referring now to the embodiment of FIGS. 11 to 16, the traveler is generally similar to the embodiment of FIG. 10 except that the arm 311 is provided with an eye 311 extending from the upper surface to the lower surface of the arm. FIG. 11 shows the shuttle 315 mounted to the upper traveler body 302*e* by means of a slider pin 316 extending across the traveler upper body 302*e*. The shuttle 315 is provided with a bore through which the slider pin extends such that the shuttle can slide across the body from one extreme position to another. The slot 304 is defined between the edges of the paddles 302*c* 302*d*, which are both pivotally mounted by means of pivot fixings 326 to the upper traveler body 302*e*.

In the embodiment shown in FIGS. 10 to 16 and as clearly shown in FIG. 11, the shuttle 315 is attached to the arm 311, such that as the shuttle 315 moves so too does the arm 311. The arm is however rotatable through at least 180 degrees (typically fully 360 degrees) with respect to the shuttle 315. A mounting spindle 317 passes through a circular aperture 319 in the arm 311 to be received in a blind bore 18 in the upper surface of the shuttle 15. The spindle 19 is provided with a cap 320. The slider pin 316 passes through the spindle 319. The arm 311 in most cases will only be required to be rotatable with respect to the shuttle 15 or traveler body 2 through 180 degrees. This will enable the arm to be used on either opposed side of the safety line. It should be noted that, in the embodiment shown, the arm 311 is inclined outwardly and downwardly from the traveler to a degree to cross the level of the safety line. This ensures that when the traveler is in use the arm 311 when rotated will only do so until it clashes with the safety line or intermediate support (as shown most clearly in FIG. 16). The arm therefore extends outwardly and in a transverse direction to pass across the level of the safety line position in the traveler 301.

Figure 12:
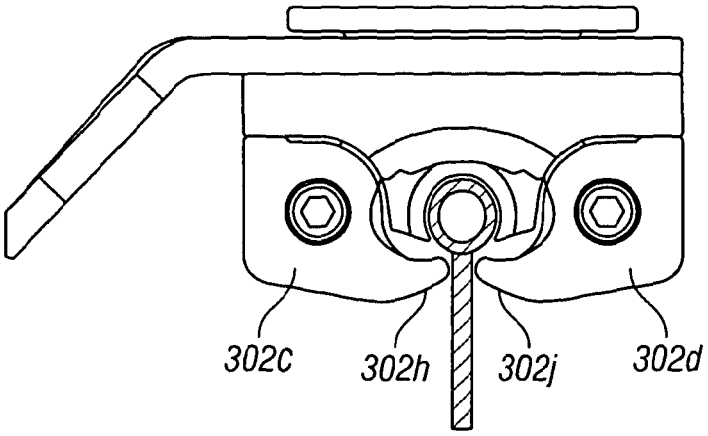
FIG. 12 is a view of the embodiment of FIG. 11 mounted on an intermediate support for a safety line.

As shown in FIG. 12, the shuttle 315 is located centrally over the slot 304 as it passes the intermediate support 6 such that the narrow section 8 can move through the slot 304. This is because the traveler 301 is in its neutral position as it is dragged past the support 6, in which the traveler is orientated horizontally (i.e. the slot is horizontal). In a 'normal' configuration as shown in FIG. 12, the paddles 302*c* 302*d* are arranged to be orientated under gravity such that a turning moment arises about the pivot fixings 326 327 to urge the shoulders 302*f* 302*g* into engagement with reaction surfaces provided on the upper body element 302*e*. In this orientation the slot 304 between edges 302*a* 302*b* is sufficiently large to allow the narrow section 8 to pass through the gap as the traveler moves past the intermediate support.

Figure 13:
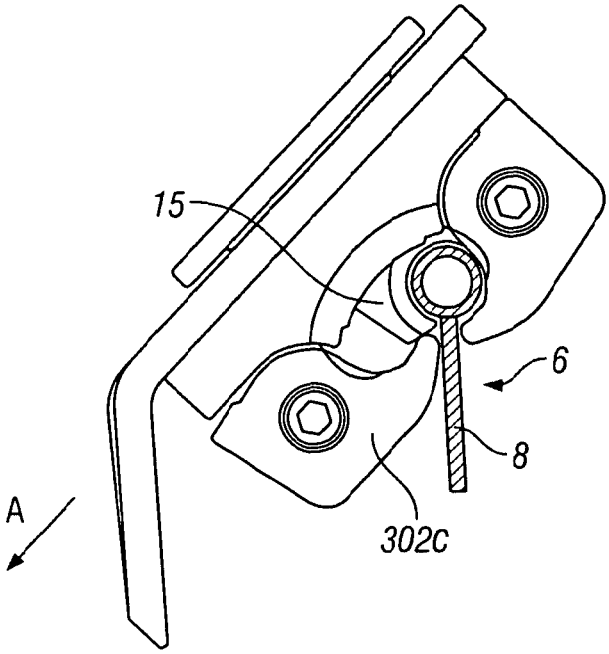
FIGS. 13 and 14 are views of the embodiment of FIGS. 11 and 12 at opposite extremes of rotational orientation with respect to the intermediate support of the safety line.

As shown in FIG. 13, if the traveler 301 is dragged past the intermediate support 6 in circumstances in which the lanyard is pulling downwardly on the arm 311 (arrow A), the traveler rotates such that the slot 308 is no longer orientated horizontally. As a result, the shuttle 315 becomes re-orientated by moving upwardly and to the right in the figure to its extreme right position. Simultaneously, when approaching the support 6, the paddle 302*c* becomes re-orientated as a result of contact between surface 302*h* and the leading edge of the narrow section 8 of the support, so as to displace the paddle 302*c* such that its edge 302*b* rotates upwardly toward the shuttle 315. This permits the narrow part 8 of the intermediate support 6 to pass through the re configured slot 304. This permits the narrow part 8 of the intermediate support 6 to pass through the slot 304.

Figure 14:
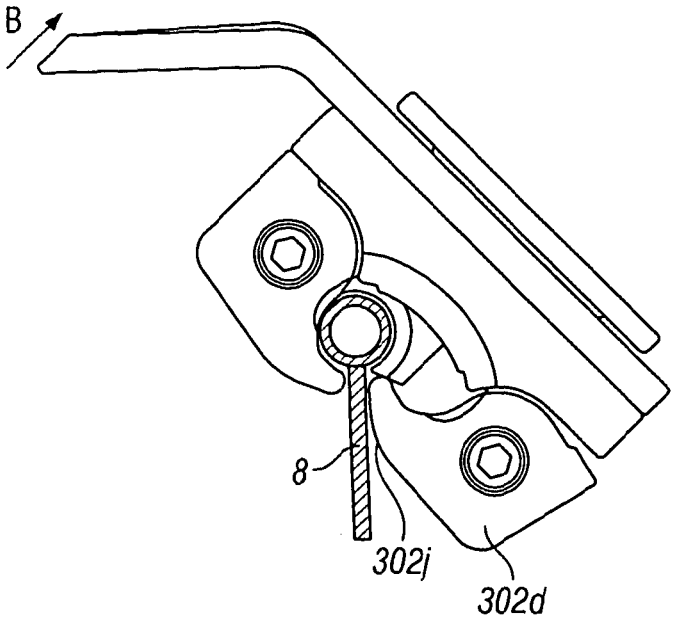
Figure 15:
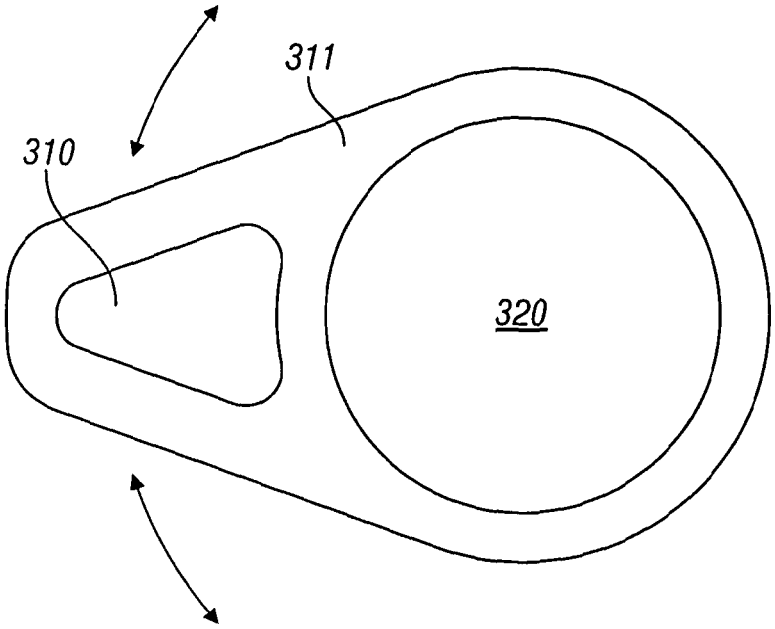
FIG. 15 is a plan view of the traveler of FIGS. 11 to 14.
Figure 16:
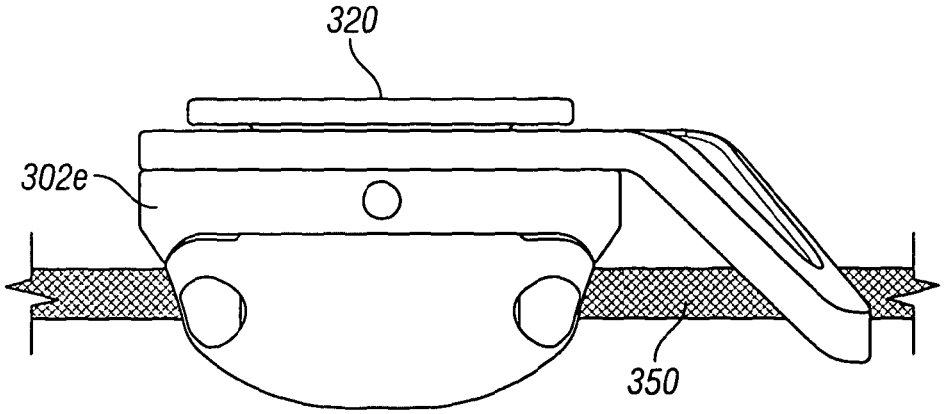
FIG. 16 is a side view of the embodiment of FIGS. 11 to 15 in position on a safety line.

FIG. 14 shows the reverse situation in which the traveler 301 is dragged past the intermediate support 6 in circumstances in which the lanyard is pulling upwardly on the arm 311 (arrow B). The shuttle 315 becomes re-orientated by moving upwardly and to the left in the figure to its extreme left position. Simultaneously, when approaching the support 6, the paddle 302*d* becomes re-orientated as a result of contact between surface 302*j* and the leading edge of the narrow section 8 of the support, so as to displace the paddle 302*d* such that its edge 302*a* rotates upwardly toward the shuttle 315. This permits the narrow part 8 of the intermediate support 6 to pass through the slot 304.

The combined use of the re-orientatable paddles to define the slot and the shuttle 315 provides maximum benefits in terms of use.

Referring now to FIGS. 17 to 28, there is shown a further embodiment of traveler that embodies the re-orientatable paddles 402*c* 402*d* and also the shuttle 415 and includes further functionality in that one of the paddles 402*d* can be moved from its 'normal' position to an open position in which the slot 404 defined by the spacing between the edges 402*a* 402*b* of the paddles is large enough for the diameter of the safety line to pass through. For safety reasons the paddle 402*d* can only be moved from the normal position to the open position when a pair of actuator buttons 431 432 are pressed simultaneously into the traveler upper body 402*e*.

Furthermore the arrangement is such that the pair of actuator buttons 431 432 can only be pressed simultaneously into the traveler upper body 402*e* when the shuttle 415 is in a specific position with respect to the traveler upper body 402*e*. This ensures that the safety line can only be received into the shuttle when the shuttle 415 is correctly aligned to receive the safety line and prevents the safety line being incorrectly inserted via the between the edges 402*a* 402*b* of the paddles into a space to one side or the other of the shuttle 415.

A further feature is that the button actuators 431 432 are biased outwardly by means of springs 433 434 such that when released they revert to their position projecting outwardly from the upper traveler body 402*e*. In moving back to that position, the paddle 402*d* is urged back to the normal position in which the gap between the paddle edges 402*a* 402*b* is sufficiently small too prevent the safety line from passing out of the traveler 401 via the slot 404.

Figure 17:
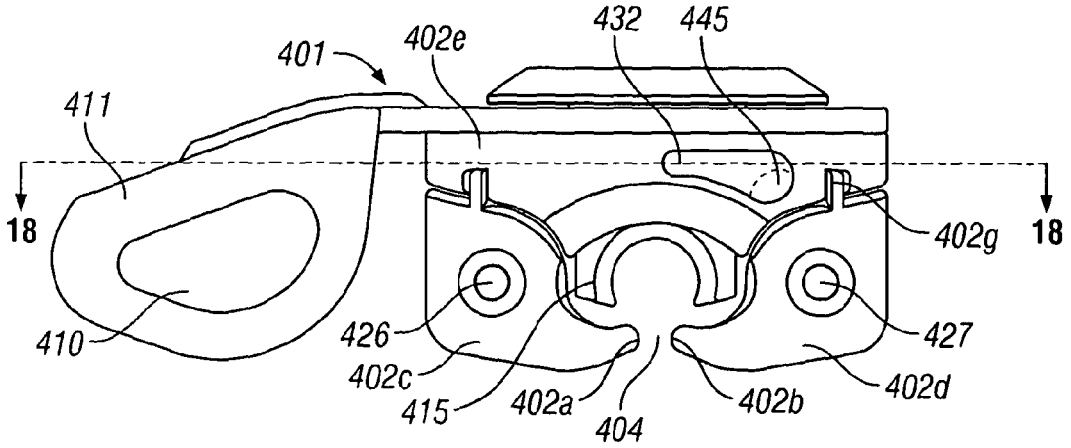
FIG. 17 is a side view of a further alternative embodiment of traveler in accordance with the invention.
Figure 18:
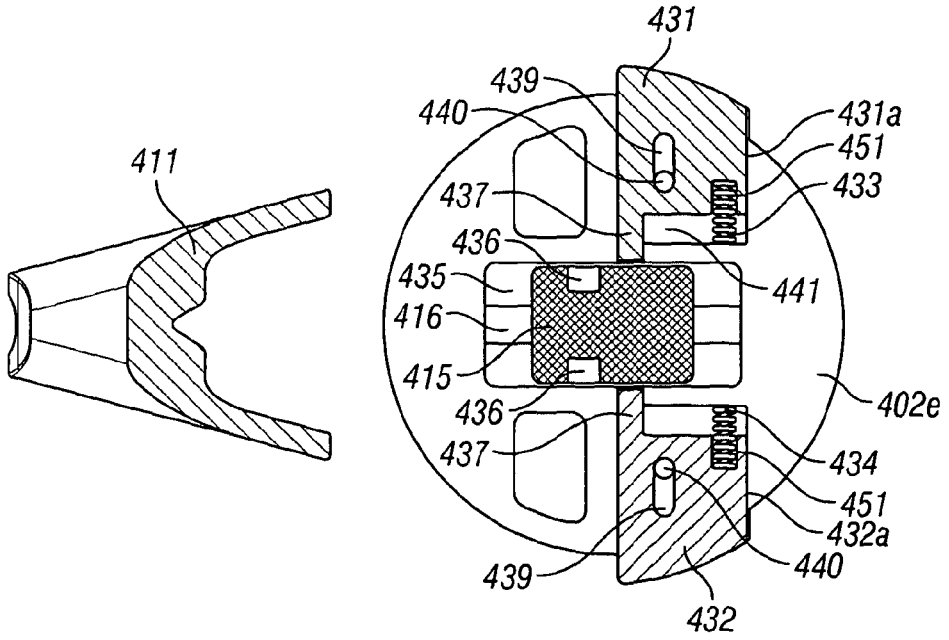
FIG. 18 is a sectional view along the sectional line shown on FIG. 17.
Figure 19:
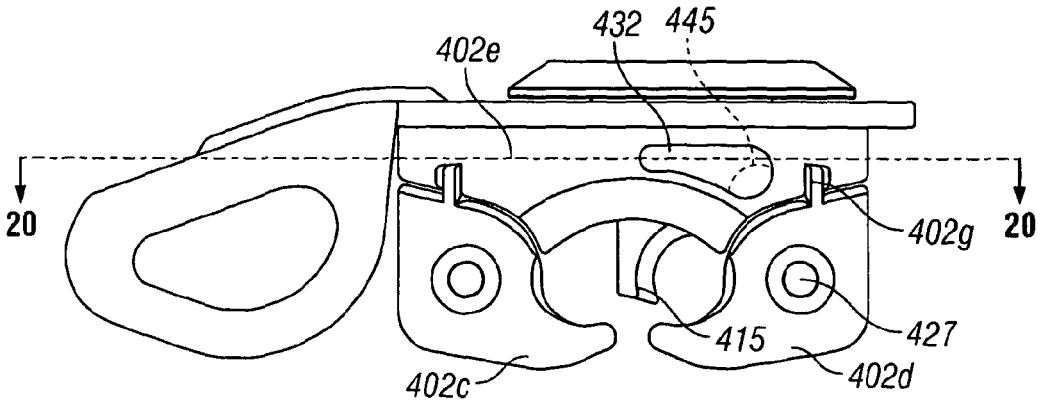
FIG. 19 is a side view of the traveler of FIGS. 17 and 18 in an alternative configuration in which one of the paddles can be opened to permit mounting on the safety line.
Figure 20:
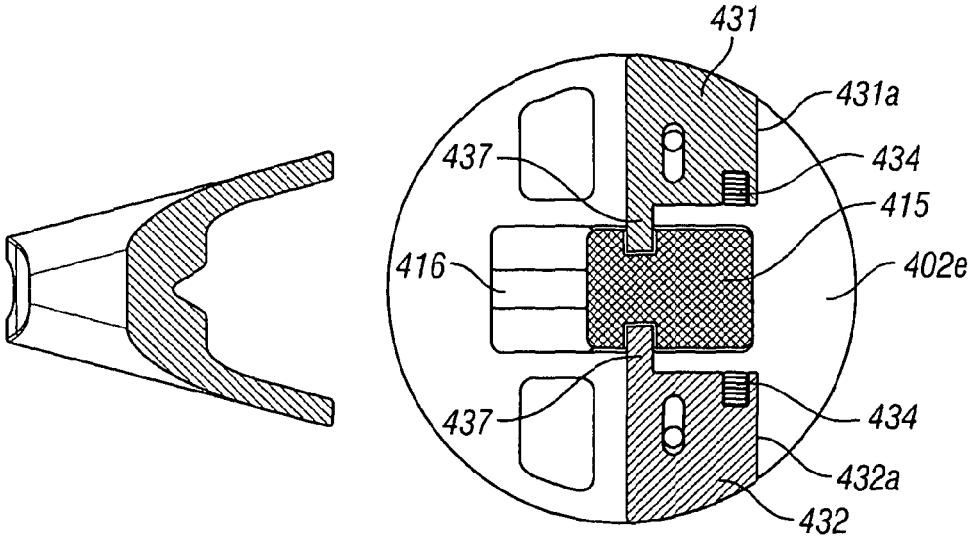
FIG. 20 is a sectional view along the sectional line shown on FIG. 19.
Figure 21:
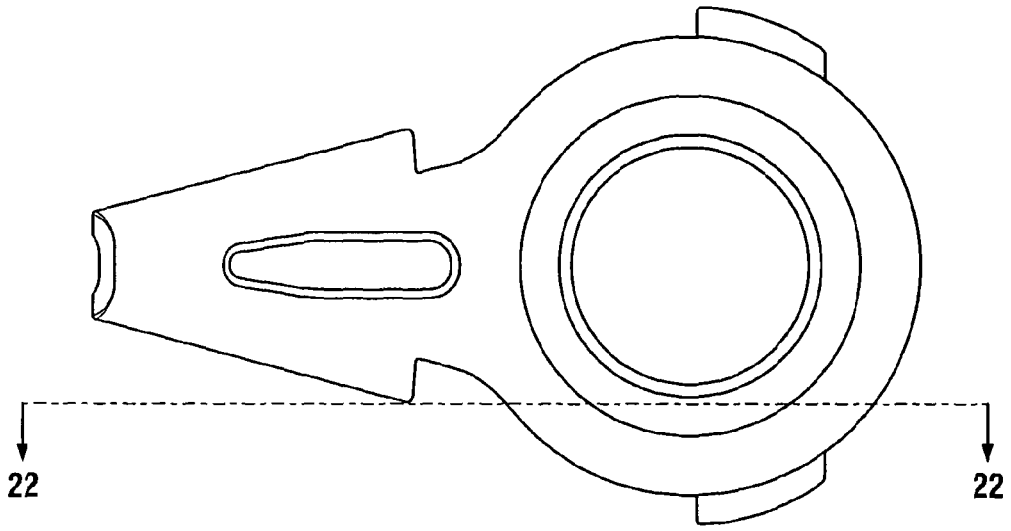
FIG. 21 is a plan view of the traveler of FIGS. 17 to 20.

In FIGS. 17 and 18 the shuttle 415 is shown in its intermediate position directly opposite the slot. The shuttle 415 is freely movable across from one side of the slot 404 to the other as in the earlier described embodiments. The shuttle 415 travels on the slider pin 416 guided in a channel 435 in the upper traveler body 402*e*. The button actuators 431 432 are biased outwardly by the springs 433 434 and project outwardly from the traveler upper body 402*e* on opposed sides of the traveler 401. The button actuators slide in respective recesses 441 in upper traveler body 402*e* and have guide slots 439 which accommodate a fixed guide pin 440 in order to guide the travel of the respective button actuator.

The shuttle 415 is provided at opposed sides with respective recess formations 436 which are shaped and dimensioned to receive complementary engagement projections 437 provided on the button actuators 431 432. The alignment of the recess formations 436 of the shuttle 415 with the projections 437 of the button actuators 431 432 only occurs when the shuttle 415 is slid to a specific position with respect to the upper body 402*e* and slot 404 (i.e. the spacing between the edges 402*a* 402*b* of the paddles 402*c* 402*d*). In the embodiment shown the alignment position is designed to be at the maximum extent of travel of the shuttle 415 to one side of the slot 404. This is because the position is easy for the user to locate. In this specific position the button actuators 431 432 can be simultaneously pressed into the traveler body, acting against the biasing springs 433 434, such that the projections 437 of the button actuators 431 432 become engaged in the recess formations 436 of the shuttle. In this position, whilst the user keeps the button actuators depressed, the shuttle cannot be moved from its located position. This is important because the paddle 402*d* is now caused to move to an open position in which the slot 404 defined by the spacing between the edges 402*a* 402*b* of the paddles is large enough for the diameter of the safety line to pass through. The arrangement ensures that the paddle 402*d* can only be opened to accommodate the insertion of the safety line when the shuttle 415 is correctly located in the correct defined receiving position. The risk of the safety line being received into the traveler but incorrectly located on one side or the other of the shuttle 415 is therefore ameliorated.

Figure 22:
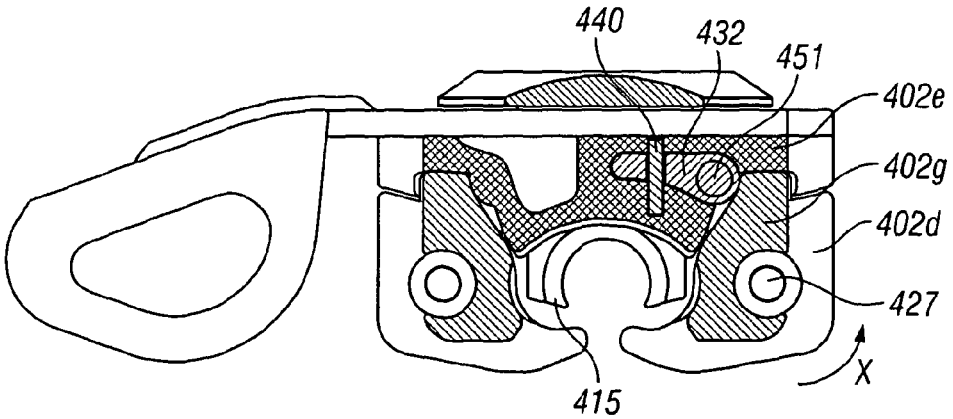
FIG. 22 is a sectional view along the sectional line shown on FIG. 21.
Figure 23:
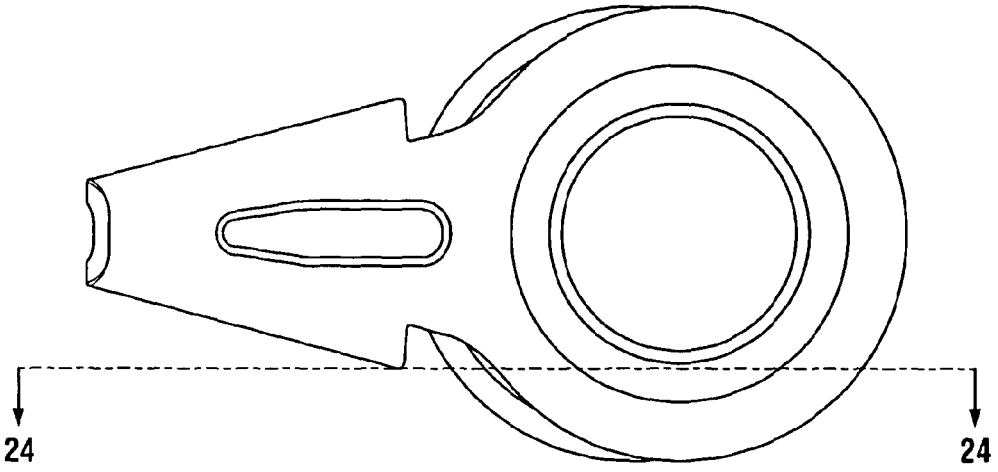
FIG. 23 is a plan view of the traveler of FIGS. 17 to 22 in the configuration of FIG. 19 in which one of the paddles can is tilted open to permit mounting on the safety line.

In the normal, closed position before and after receiving the safety line into the traveler 401, the paddle 402*c* 402*d* are in the position shown in FIG. 22. in this situation, when in use, the paddles are free to pivotally re-orientate about the pivot fixings 426 42, in a similar manner to the earlier described embodiments, to best accommodate passage through the safety line intermediate supports, the paddle. In this respect it should be remembered that in use the paddles can only pivot upwardly from the normal position in response to operating forces. Gravity (or other biasing means) normally biases the paddles to the 'normal' position shown in FIG. 22. In this embodiment paddle 402*d* is prevented from rotating on the pivot fixing 427 (counter clockwise as shown in the view of FIG. 22) to an open position, by means of two spaced upstanding projections 402*g* which abut against the forward edges 431*a* 432*a* of a respective actuator button 431 432.

The button actuators at their forward edge 431*a* 432*a* are provided with respective slots 445 spaced outwardly of the spring receiving cavities 451 of the button actuators 431 432. The upper traveler body 402*e* is provided with correspondingly aligned slots 449. When the button actuators 431 432 are not pushed fully in, the slots 445 do not align up with the slots 449 in the upper body an the upstanding projections 402*g* and the paddle 402*d* is thereby prevented from rotating on the pivot fixing 427 (counter clockwise as shown in the view of FIG. 22) to an open position, because the two spaced upstanding projections 402*g* abutting against the forward edges 431*a* 432*a* of a respective actuator button 431 432.

Figure 24:
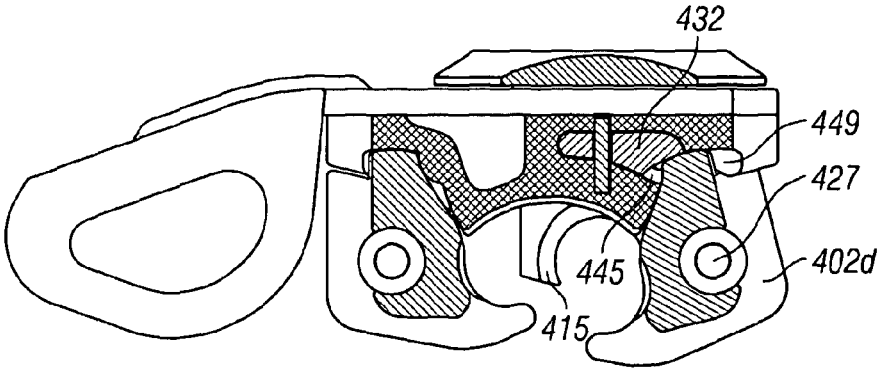
FIG. 24 is a sectional view along the sectional line shown on FIG. 23.
Figure 25:
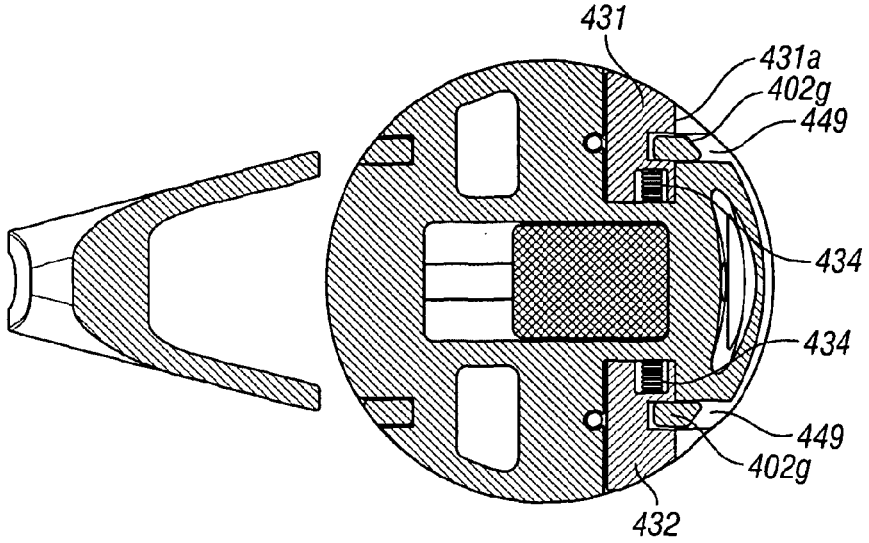
FIG. 25 is a sectional view along the sectional line shown on FIG. 26.
Figure 26:
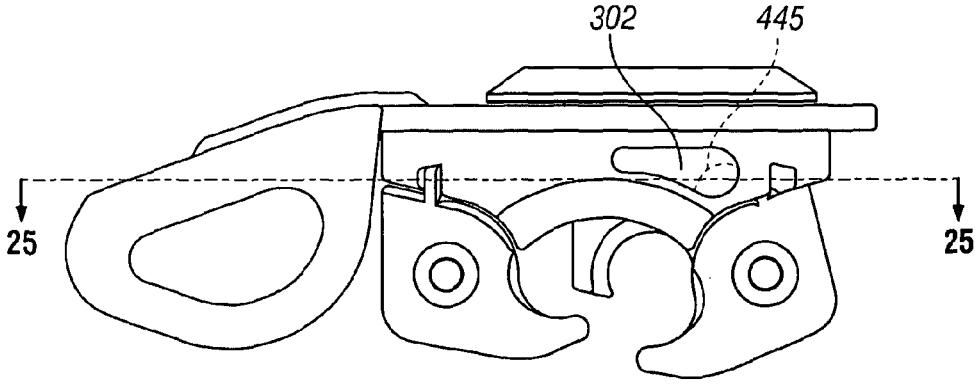
FIG. 26 is a view corresponding to the view of FIG. 19.
Figure 27:
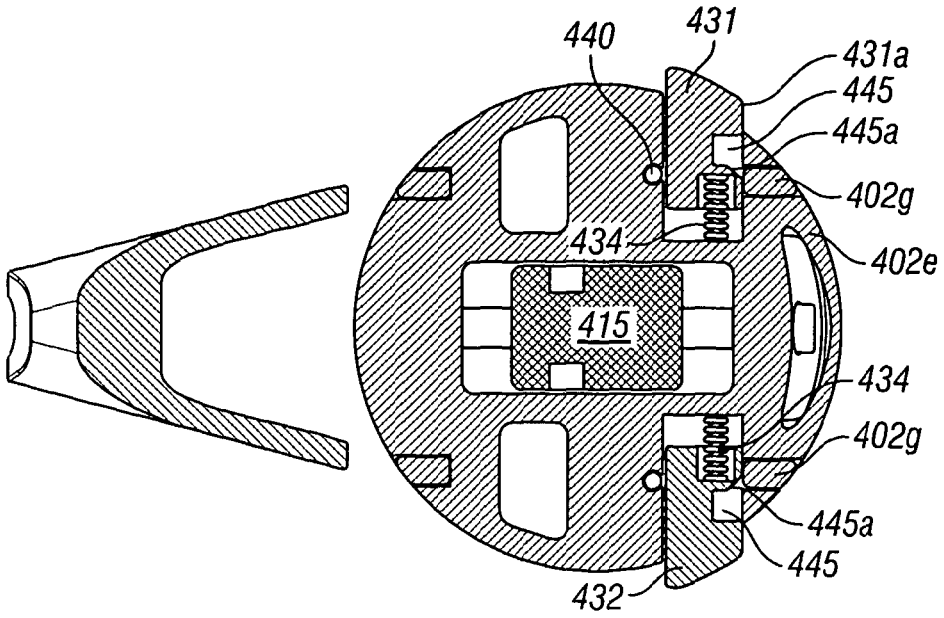
FIG. 27 is a sectional view along the sectional line shown on FIG. 28.
Figure 28:
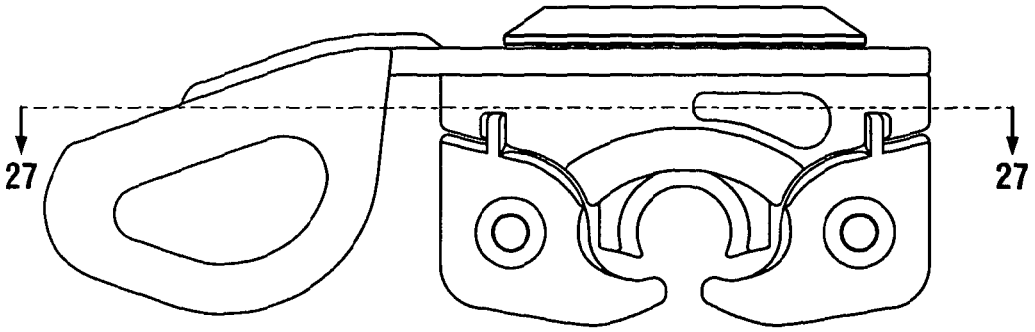
FIG. 28 is a view corresponding to the view of FIG. 17.

However, when the button actuators 431 432 are pushed fully in, the slots 445 align with the slots 449 in the upper body and the upstanding projections 402*g*. This permits the paddle 402*d* to rotate counter-clockwise (arrow X in FIG. 22)

to the fully open position as shown in FIG. 24. In constructed embodiments it has been found that paddle rotation of approximately 15 degrees has been sufficient to open the gap 404 (defined by the spacing between the edges 402*a* 402*b* of the paddles) the required degree to permit the safety line to be loaded. In the fully open position the paddle 402*d* abuts against the body 402*e* to prevent over opening of the gap 404. Once the safety line is loaded into the shuttle, the paddle 402*d* can be reverted to the closed, normal, position (i.e. back to the position of FIG. 22). Releasing pressure on the button actuators 431 432 causes the springs 433 434 to move the actuator buttons outwardly to return to their 'home' position in which the slots 445 do not align up with the slots 449 in the upper body and the upstanding projections 402*g* and the paddle 402*d* is thereby prevented from rotating counter-clockwise on the pivot fixing 427 to the open position.

In certain embodiments, the paddle 402*d* may be caused to return from the open position to the closed position automatically as the actuator buttons 431 432 move outwardly to return to their 'home' position. This may be achieved for example by having co-acting inclined surfaces 445*a* on the slots 445 of the button actuators for engagement with the projections 402*g* of the paddle 402*d*. As the actuator buttons 431 432 move outwardly to return to their 'home' position the inclined surface 445*a* acts against the projections 402*g* of the paddle 402*d* to urge the paddle from the position shown in FIG. 25 to the position shown in FIG. 27.

A further embodiment of a traveler 501 in accordance with a preferred realisation of the invention is shown in FIGS. 29 to 37. In this embodiment a shuttle 515 operable in the same manner as the previously described embodiments is provided and the slot is defined between re-orientatable paddles 502*c* 502*d*. In this instance the paddles are not pivotally mounted, so as to re-orientate by means of pivotal movement, but rather slide bodily to lift upwardly and fall downwardly with respect to the main traveler body 502*e* between a lowered position and a lifted position as the traveler 501 passes a respective intermediate support.

Figure 29:
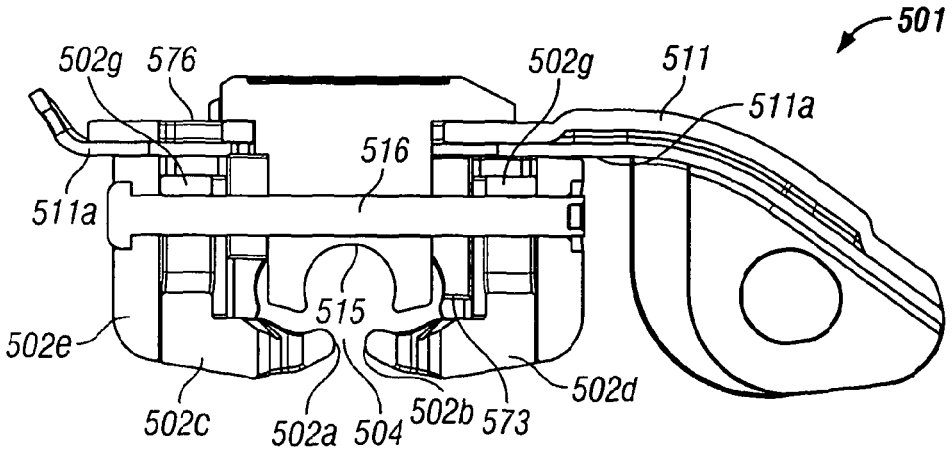
FIGS. 29 to 31 are sectional views of a further alternative embodiment of traveler in accordance with the invention, shown in different operational configurations.
Figure 32:
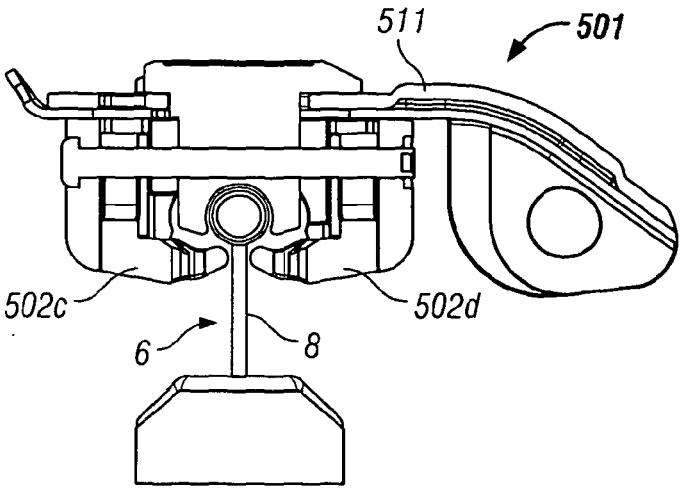
FIGS. 32 to 34 are views of the traveler of FIGS. 29 to 31 mounted on an intermediate support for a safety line in various angles of rotational orientation with respect to the intermediate support of the safety line.

As shown in FIG. 32, the shuttle 515 is located centrally over the slot 504 as it passes the intermediate support 6 such that the narrow section 8 can move through the slot 504. This is because the traveler 501 is in its neutral position as it is dragged past the support 6, in which the traveler is orientated horizontally (i.e. the slot is horizontal). In a 'normal' configuration as shown in FIG. 29, the paddles 502*c* 502*d* are arranged to be orientated under gravity to rest in their lowered position (corresponding to the position shown in FIG. 29). In this orientation the slot 504 between edges 502*a* 502*b* is sufficiently large to allow the narrow section 8 to pass through the gap as the traveler moves past the intermediate support.

Figure 33:
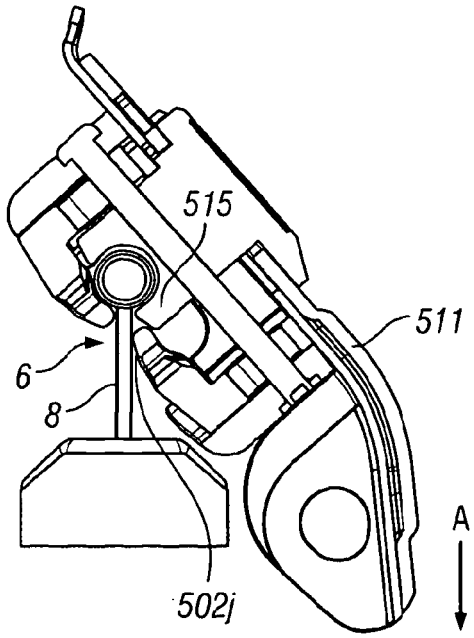

As shown in FIG. 33, if the traveler 501 is dragged past the intermediate support 6 in circumstances in which the lanyard is pulling downwardly on the arm 511 (arrow A), the traveler rotates such that the slot 508 is no longer orientated horizontally. As a result, the shuttle 515 becomes re-orientated by moving upwardly and to the left in the figure to its extreme left position. Simultaneously, when approaching the support 6, the paddle 502*d* becomes re-orientated, being lifted upwardly from its lowered at rest position as a result of contact between surface 502*j* and the leading edge of the narrow section 8 of the support, so as to displace the paddle 502*d* upwardly toward the shuttle 515. This permits the narrow part 8 of the intermediate support 6 to pass through the re configured slot 504.

Figure 34:
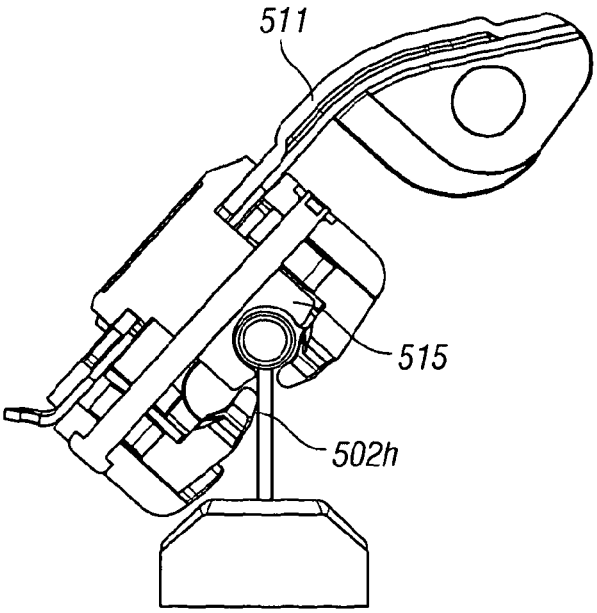

FIG. 34 shows the reverse situation in which the traveler 501 is dragged past the intermediate support 6 in circumstances in which the lanyard is pulling upwardly on the arm 511 (arrow B). The shuttle 515 becomes re-orientated, by moving upwardly and to the right in the figure to its extreme right position. Simultaneously, when approaching the support 6, the paddle 502*c* becomes re-orientated, being lifted upwardly from its lowered at rest position as a result of contact between surface 502*h* and the leading edge of the narrow section 8 of the support, so as to displace the paddle 502*c* upwardly toward the shuttle 515. This permits the narrow part 8 of the intermediate support 6 to pass through the re configured slot 504.

The combined use of the re-orientatable paddles to define the slot and the shuttle 315 provides maximum benefits in terms of use. Paddles that can slide to lift and fall bodily with respect to the traveler body rather than being pivotally mounted are believed to improve robustness and be less likely to fail in the event of a fall.

The shuttle 515 is attached to the load arm 511, such that as the shuttle 315 moves across the slot, then so too does the arm 511. The load arm 51 is however rotatable through fully 360 degrees with respect to the shuttle 515 and therefore also rotatable with respect to the main traveler body 502*e*. A mounting spindle 517 comprising the shuttle passes through a circular aperture 519 in the arm 511. The spindle 519 is provided with a cap 520. The slider pin 516 passes through the spindle 519. The rotary mounting of the arm 511 with respect to the shuttle 515 and the main traveler body 502*e* enables the arm 511 to be used on either opposed side of the safety line. It should be noted that, in the embodiment shown, the arm 511 has a karabiner attachment bracket 510, which is positioned outwardly and downwardly from the traveler to a degree to cross the level of the safety line. This ensures that when the traveler is in use the load arm 511, when rotated, will only do so until it clashes with the safety line or intermediate support. The arm therefore extends outwardly and in a transverse direction to pass across the level of the safety line position in the traveler 501.

Figure 30:
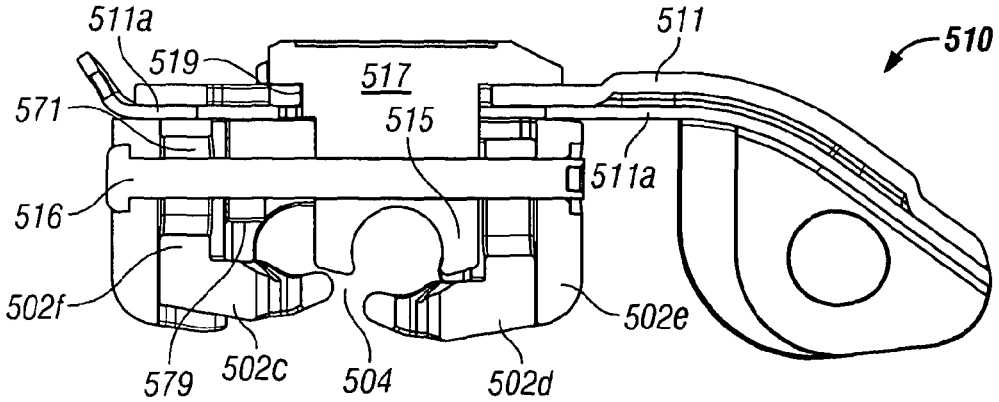
Figure 31:
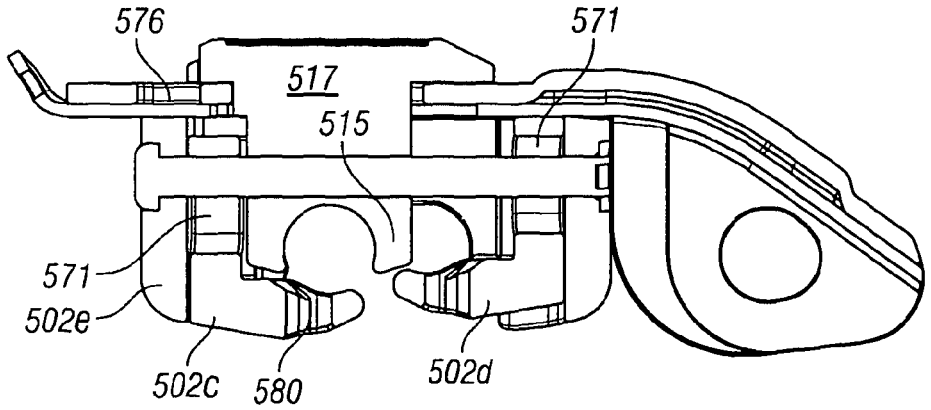

In this embodiment, the shuttle 515 is mounted to the upper traveler body 502*e* by means of a slider pin 516 extending across the traveler upper body 502*e*. The shuttle 515 is provided with a channel through which the slider pin 516 extends such that the shuttle can slide across the body from one extreme position to another (the opposed extreme shuttle positions are shown in FIGS. 30 and 31 respectively). The slot 504 is defined between the edges 502*a* 502*b* of the paddles 502*c* 502*d*, which are both slidably mounted with respect to the upper traveler body 502*e*.

Figure 38:
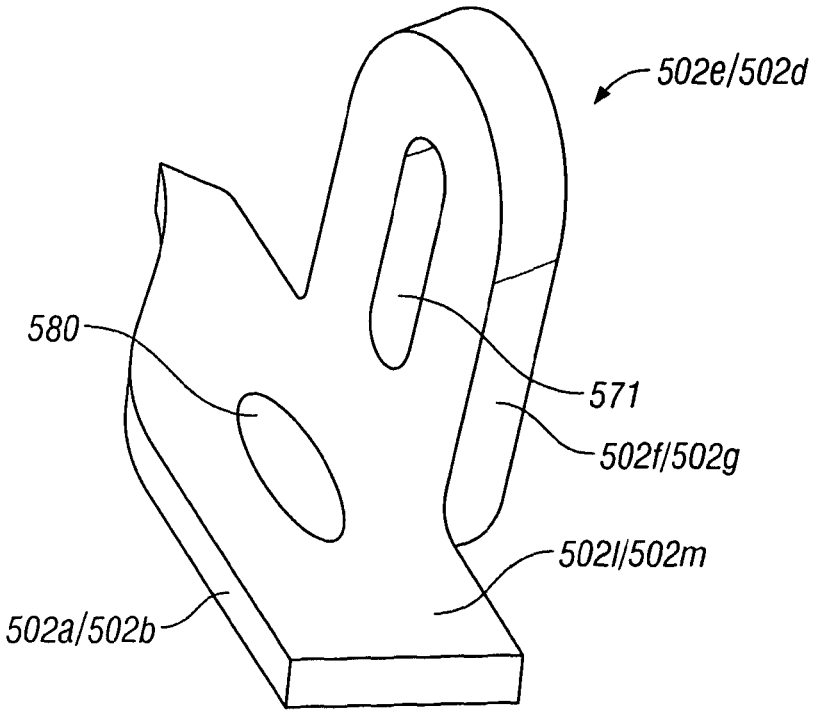
FIGS. 38 and 39 are detail views of parts of the traveler of FIGS. 29 to 37.

The paddles 502*c* 502*d* are both slidably mounted with respect to the upper traveler body 502*e* in respective guide channels in the main traveler body 502*e*. The paddles slide in a transverse direction to the direction of movement of the shuttle with respect to the main traveler body 502. An exemplary paddle 502*d* is shown in FIG. 38. Each paddle has a stem portion 502*f* 502*g* which is constrained to move upwardly and downwardly in the guide channel in the main traveler body 502*e*, and a transverse portion 502*l* 502*m* which extends away from the respective stem portion terminating at the paddle tips 502*a* 502*b* which are spaced to define the slot 504 between the paddle elements. The stem portions 502*f* 502*g* of the paddles are each provided with an upwardly orientated slot 571 through which the slider pin 516 passes. In the lowered position resting under gravity, both of the paddle elements 502*c* 502*d* are at rest suspended from the slider pin 16, and prevented from becoming separated from the main traveler body by the slider pin 516 passing through the slot 571 in the stem portion of the respective paddles 502*c* 502*d*. This position is shown in FIG. 29.

The 'in operation' upward limit of sliding movement of paddle 502*d* is defined by an abutment shoulder 573 carried by the main traveler body 502*e*. The paddle 502*d* abutting the shoulder 573 in the uppermost operational position of the paddle 502*d* is shown in FIG. 31. In this position the upper surface of the stem portion 502*g* of the paddle 502*d* lies flush with the upper surface of the main traveler body 502*c* and abuts against the underside surface of the lower arm element 511*a*.

The 'in operation' upward limit of sliding movement of paddle 502*c* is defined by the position in which the upper surface of the stem portion 502*f* of the paddle 502*c* lies flush with the upper surface of the main traveler body 502*e* and abuts against the underside surface of the lower arm element 511*a*. The paddle 502*c* abutting the underside surface of the lower arm element 511*a* in the uppermost operational position of the paddle 502*c* is shown in FIG. 30.

In all the operational positions of the shuttle 515 and paddles 502*c* 502*d* when the karabiner is attached to the attachment 510, the slot gap 504 between the edges of the paddles 502*c* 502*d* is maintained sufficiently small that the safety line to which the traveler is secured cannot pass out of the traveler body 502.

In order to permit the traveler 501 to be secured to the safety line or removed from the safety line, the components of the traveler 501 must be configured in a specific orientation in order to enable the paddle 502*c* to be raised to a line-mounting/de-mounting position, which is raised above its 'in operation' upward limit. This position is shown in FIG. 37, in which the safety line can pass through the expanded gap 504 between the paddle 502*c* 502*d* edges into or out of the shuttle 515. An advantageous feature of the arrangement is that in the line loading position, the karabiner cannot be secured to the arm attachment 510. Conversely, the arrangement cannot be configured for line loading or unloading whilst the karabiner remains attached to the attachment bracket 510.

Figure 39:
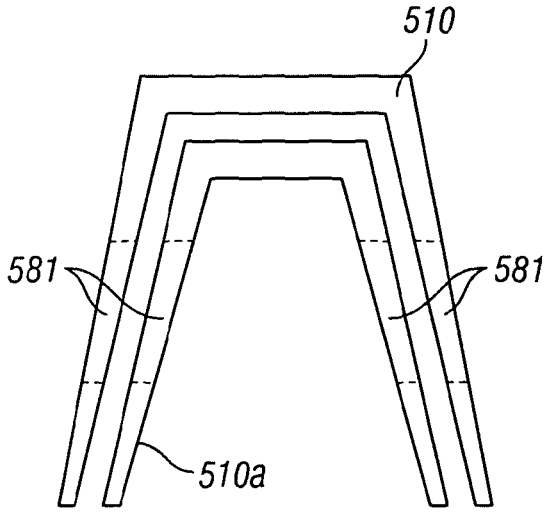

In order to achieve this the lower arm element 511*a* is provided with an attachment bracket 510*a* which is slidable linearly with respect to the upper arm element 511 (and bracket portion 510) between a position in which karabiner receiving apertures 581 on the attachment brackets 510*a* 510 are coaxially aligned (FIGS. 35 and 39) and a position in which the karabiner receiving apertures on the attachment brackets 510*a* 510 are in maximum mis-alignment (FIG. 36). An elongate slot is provided in the lower arm element 511 to permit sliding relative to the upper arm element 511 and also the shuttle 515. As shown in FIG. 39 the inner attachment bracket 510*a* is nested within the outer attachment bracket 510, each generally being 'U' shaped in configuration.

In order to configure the device in the safety line-mounting/de-mounting position, the lower arm 511*a* must first be moved to the position in which the karabiner receiving apertures on the attachment brackets 510*a* 510 are in maximum mis-alignment (FIG. 36). In this position, the slot in the lower arm 511*a* directly overlies the guide channel in the traveler main body 502*e*, which guides the stem 502*f* of the paddle 502*c*. In this position the slot in the lower arm 511*a* additionally lies directly under an aperture 576 in the upper arm 511. The slot in the lower arm 511*a* and the aperture 576 in the upper arm 511 are both shaped and dimensioned so as to permit the stem 502*f* of the paddle 502*c* to pass upwardly through the arms 511 and 511*a*, to the raised line-mounting/de-mounting position which is lifted above the 'in operation' upward limit of the paddle 502*c*. This position is shown in FIG. 37. It should be noted that in the raised line-mounting/de-mounting position shown in FIG. 37, the paddle 502*c* abuts against a shoulder 579 provided on the traveler main body 502*e*. The shoulder 579 is provided at a raised level with respect to the shoulder 573. Also, the paddle 502*c* is provided with an aperture 580 configured to accommodate a peripheral edge of the shuttle 515 enabling the paddle 502*c* to be raised to the raised line-mounting/de-mounting position.

As mentioned earlier, an advantage of this embodiment of the invention is that the paddles are not pivotally mounted, which reduces components and also improves robustness of construction. Additionally, the traveler can only be configured in the raised line-mounting/de-mounting position when the attachment brackets 510*a* 510 are in maximum mis-alignment (FIG. 36). This means that the traveler cannot be de-mounted from the line when the karabiner is attached. A further advantage of the arrangement is that the safety line can only be correctly inserted into the receiving saddle of the shuttle 515 and cannot be inserted in error into another portion of the internal cavity of the traveler body 502. This is because access to other portions the internal cavity of the traveler body 502 is obscured by the position of the shuttle 515 and paddles 502*c* 502*d* when orientated in the mounting/de-mounting position.

Effectively, the slot 504 is re-configurable between an open condition in which the slot dimension is of a first size for enabling mounting/de-mounting with respect to a safety line; and a closed condition, locked by the lower arm 511*a*, in which the slot 504 remains, but at a smaller size to ensure the traveler remains mounted on the safety line. In the closed condition the opposed slot edges are still moveable freely movable relative to one another to reconfigure the slot giving the improved flexibility to pass the safety line intermediate supports. However the range of slot sizes over the range of slot edge movement in the closed condition is such that the traveler cannot disengage from the safety line via the slot 504.

The traveler of the invention can be used effectively with standard types of intermediate support currently in use. No special deflectors or modifications need to be made to existing standard types of intermediate support.

The invention claimed is:

1. A traveler for safety line for a fall arrest system, the traveler comprising:

a body defining an interior space;

a slot extending to the exterior of the traveler; and a safety line locating shuttle provided on-board the traveler within the interior space of the body;

wherein the safety line locating shuttle is movable relative to the slot along a predetermined path in a direction transversely across the slot, and wherein the slot is defined between opposed slot edges which are deflectable by means of sliding movement perpendicular to the predetermined path of the shuttle to reconfigure the slot.

2. A traveler according to claim 1, wherein:

the safety line locating shuttle comprises a shuttle configured to embrace and guide a safety line.

3. A traveler according to claim 1, wherein:

the safety line locating shuttle comprises a receiving recess or seat for receiving the safety line.

4. A traveler according to claim 1, wherein:

the shuttle is spaced from the slot in-board the traveler of the slot.

5. A traveler according to claim 1, wherein:

the safety line is arranged to be positioned between the shuttle and the slot.

6. A traveler according to claim 1, wherein:

the slot is dimensioned to be smaller than the transverse dimension of the safety line such that the safety line cannot pass sideways through the slot.

7. A traveler according to claim 1, wherein:

the safety line locating shuttle is slidable relative to the slot.

8. A traveler according to claim 1, wherein:

the safety line locating shuttle is movable in a direction relative to the traveler across the slot between a first extreme position, more to one side of the slot, and a second extreme position, more toward the other side of the slot.

9. A traveler according to claim 1, wherein:

the safety line locating shuttle is slidably mounted to the body.

10. A traveler according to claim 1, further comprising:

a load member for attachment to fall safety equipment.

11. A traveler according to claim 10, wherein:

the load member can be rotated through 180 to 360 degrees about an axis to enable the load member to project in one of opposed directions from the traveler.

12. A traveler according to claim 1, wherein:

a respective edge is provided on a support element, which is mounted to be bodily slidable with respect to the traveler.

13. A traveler according to claim 1, wherein:

the direction of sliding movement to reconfigure the slot is in a direction generally perpendicular to the axis of the safety line when in the traveler.

14. A traveler according to claim 1, wherein:

each of the opposed edges defining the slot are provided on a respective support element which is movably mounted to the traveler.

15. A traveler according to claim 1, wherein:

each slot edge is deflectable under gravity to a neutral position.

16. A traveler according to claim 1, wherein:

in a closed configuration, the slot width between the edges is small enough to prevent the safety line passing via the slot out of captive engagement with the traveler.

* * * * *